United States Patent [19]

Hansen et al.

[11] 4,180,714

[45] Dec. 25, 1979

[54] PRESSURE-DEPENDENT ELECTRIC SWITCHING DEVICE

[75] Inventors: Peter R. Hansen, Nordborg; Niels P. Thorsen, Sonderborg, both of Denmark

[73] Assignee: Danfoss A/S, Nordborg, Denmark

[21] Appl. No.: 911,882

[22] Filed: Jun. 2, 1978

[30] Foreign Application Priority Data

Jun. 13, 1977 [DE] Fed. Rep. of Germany ..... 2726608

[51] Int. Cl.[2] ..... H01H 35/32

[52] U.S. Cl. ..... 200/81 R; 200/83 C; 200/83 X S

[58] Field of Search ..... 200/81 R, 83 R, 83 WM, 200/83 C, 83 S, 83 SA, 293, 294, 307; 220/3.6, 3.7; 174/58

[56] References Cited

U.S. PATENT DOCUMENTS

| | | | |
|---|---|---|---|
| 2,620,413 | 12/1952 | Johnson | 200/83 SA |
| 3,256,398 | 6/1966 | Snider | 200/83 SA |
| 3,968,338 | 7/1976 | Zdanys | 200/307 |
| 4,098,423 | 7/1978 | Narrero | 220/3.7 |
| 4,115,674 | 9/1978 | Budlane | 200/83 S |

*Primary Examiner*—Gerald P. Tolin
*Attorney, Agent, or Firm*—Wayne B. Easton

[57] ABSTRACT

The invention relates to a pressure responsive electric switching device of the type in which a switch actuating element is oppositely loaded by pressure influenced operating element and an adjustable spring. The switch actuating element is mounted in a sheet metal carrier and the switch to be actuated is mounted in an insulated housing. The connection between the carrier and the housing involves the cutting of the carrier sidewalls in a manner to form lugs and the providing of grooves in the insulated housing for receiving the lugs. The carrier sidewalls also have cut-outs formed in a manner to economically provide knife-bearings for pivotally mounted elements of the switching device.

17 Claims, 7 Drawing Figures

PRESSURE-DEPENDENT ELECTRIC SWITCHING DEVICE

The invention relates to a pressure-dependent electric switching device in which an actuating element is loaded on the one hand by a pressure-influenced operating element and on the other hand by a spring that can be adjusted by a rotary servo-element, and acts on a switching system arranged in an insulating housing with an actuating aperture, and wherein the operating element and insulating housing are secured to a carrier.

This switching device is to be suitable particularly as an evaporator thermostat for refrigerators but can also be used as a pressostat, over-pressure switch, thermostat of which the sensor has a liquid/vapour filling, and many other purposes.

A switching device of the aforementioned kind is known in which a housing-like carrier there are arranged on one side wall the operating element in the form of a corrugated tube and on the opposite side a servo-element which is in the form of a screw and has a rotary knob. The actuating element is axially displaceable; it is loaded at one end by the operating element and at the other end by a helical spring supported against the servo-element. This actuating element acts by way of an entrainment on an adjacent microswitch of which the insulating housing is screwed to the carrier. Such a switching device requires comparatively expensive individual parts and involves expensive assembly. In addition, the space requirement is relatively large.

The invention is based on the problem of providing a very cheap appliance in a switching device of the aforementioned kind by selecting and forming the individual parts and providing a simple assembly.

This problem is solved according to the invention in that the sheet metal carrier comprises cut-outs in two parallel side walls extending perpendicular to a base wall, a lug remaining between the respective cut-outs, and that the insulating housing has two parallel grooves or apertures into which the lugs are pressed.

In this construction, the carrier consists of a simple punched and bent part. The connection to the switching system takes place simply by pressing the insulating housing onto the lugs. The use of screws, screwthread cutting and cumbersome screwdriving are omitted. For all this it is only necessary to make the insulating housing somewhat larger so as to accommodate the apertures.

To improve the secure seating, the lugs may have barbs in the form of small stamped teeth.

It is advantageous if the lugs are perpendicular to the base wall, the grooves or apertures in the insulating housing extend parallel to the actuating aperture, and the actuating element is a swing arm between the insulating housing and the base wall. In this way one obtains a very compact construction in which the actuating aperture of the switching system is well protected. One can even use an actuating swing arm with a pin which acts through the actuating aperture of the insulating housing directly on the switching system.

A considerable reduction in the overall dimensions and thus a corresponding saving in material can be achieved if the operating element is disposed at one end of the carrier between the side walls and if the actuating element is a bell crank which is pivoted in the side walls by its end remote from the actuating end. Between the operating element and the insulating housing one need then leave only sufficient space for the one limb of the bell crank, the spring and possibly other transmission elements.

In a preferred embodiment, the bell crank has two lateral bearing lugs at its end opposite the actuating end and the side walls each have a first bearing punch-out which has a knife edge on the side remote from the operating element and is connected by way of a slot, which is offset from the knife edge for introducing the bearing lugs, to the free edge of the side wall opposite the base wall. Such a bell crank is simply pushed with the two bearing lugs through the slots in the bearing punch-outs where the bearing lugs are pushed against the knife edges under the pressure of the operating element. This is an extremely simple assembly step.

The bearing lugs may be provided with a notch adapted to the knife edge in order to reduce friction.

With particular advantage, the spring is formed by a leaf spring of which one end is secured to the bell crank on the side of the pivotal axis opposite to where the operating element engages and the other end can be fixed near the base wall by means of the servo-element. This leaf spring takes up extremely little space so that one again obtains a corresponding saving in material.

To enable appropriately large spring forces to be exerted or a desired spring characteristic to be achieved, one can also use at least two superposed leaf springs.

In a further development, provision can be made for the fact that the servo-element acts on a pivot plate carrying a set screw near one end for acting on the spring and having two bearing lugs at the other end, and that the side walls each have a second bearing punch-out which has a knife edge on the side remote from the operating element and is connected by way of a slot, which is offset from the knife edge for introducing the bearing lugs, to the free edge of the side wall opposite the base wall. This pivot plate can likewise be very simply assembled. It is likewise pushed against the bearing knife edges by the forces available in the system. The set screw interposed between the servo-element and spring permits a rapid adjustment to be made after assembly. The pivot plate bearing can be disposed substantially above the point of engagement of the servo-element to ensure positive engagement of the servo-element with the pivot plate.

To secure the set screw against turning, the pivot plate may have a bent-out projection for engagement by the servo-element, a clamping element penetrated by the set screw engaging over the projection.

It is recommended further that the servo-element has a shank which passes through the base wall and carries a cam plate on the inside of the base wall and a collar on the outside of the base wall, of which the one part is secured to the shank by being subsequently pressed on. By means of the cam plate one obtains one axial fixing of the shank and by means of the collar to the other. The use of the cam plate is possible particularly in conjunction with the leaf spring because its position is to be fixed near the base wall. The assembly of the servo-element therefore merely calls for a pressing operation.

For example, the shank may be of a material softer than metal, such as plastics, and the steel collar may have inwardly directed barbed teeth. In this case it is even possible to make the cam plate in one piece with the shank.

Another possibility is for the shank to be of steel, to be in one piece with the collar and have a pin at the end, and for the cam plate to be of a material softer than steel, such as plastics, and comprise an aperture in which the pin is pressed. In this case the pin may have barbed teeth. Particularly positive entrainment for rotation will be obtained if the shank on the one hand and a bearing extension of the cam plate on the other hand are mounted in a sleeve on the base wall and if the pin is eccentrically disposed or has a non-circular cross-section.

Further, the servo-element may comprise a cam disc which is disposed between the cam plate and base wall and makes direct engagement with an extension on the bell crank in the end position of the servo-element. The bell crank can therefore be locked in its end position with the aid of the cam disc. By using a plastics cam plate, it is advisable to keep the cam disc of steel so that it simultaneously serves to protect the cam plate when rubbing on the base wall.

It is also advantageous for the base wall to be pressed inwardly around the bearing aperture for the servo-element shank, and for at least one lug to be bent out of the base wall, which lug is disposed in the path of a lug of the cam disc bent towards the base wall. One therefore also requires no additional elements for assembly in order to fix the end position.

If the operating element is mounted on an end plate which is secured by means of bent-over lugs to one end of the base wall and side walls, particularly simple sheet metal parts are obtained. In particular, the carrier can be finished by punching and stamping whereas the operating element with its end plate can be prefabricated and need not be applied until assembly.

In those cases where, in addition to setting the range by means of the servo-element, it is also desired to set the difference, it is advisable for the switching system to be a distance-dependent snap switch and for the insulating housing to contain an abutment screw with which the difference of the snap switch is adjustable. Simple turning of the screw will alter the snap distance and thus the difference.

The invention will now be described in more detail with reference to examples shown in the drawing, wherein:

FIG. 1 is a section through a switching device according to the invention just before insertion of the insulating housing;

FIG. 1*a* is a plan view of an insulated housing for the switching device of FIG. 1;

Figure 1:
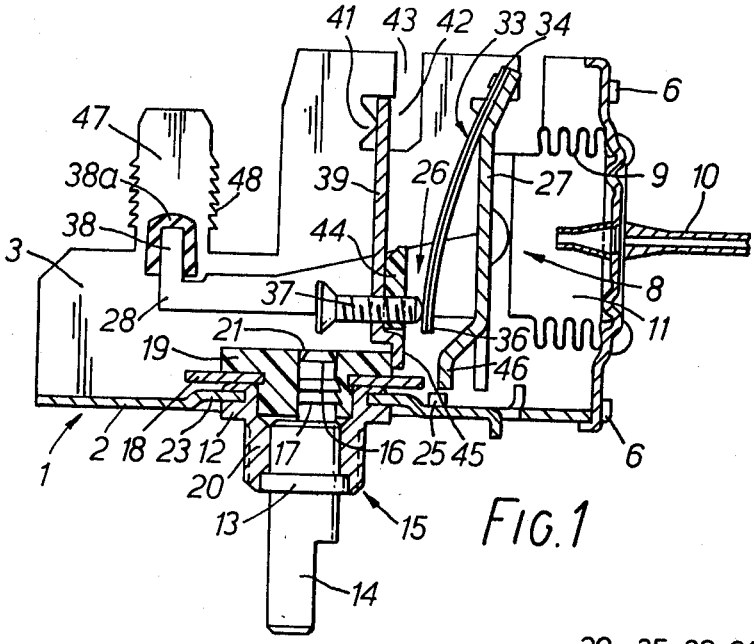
Figure 1A:
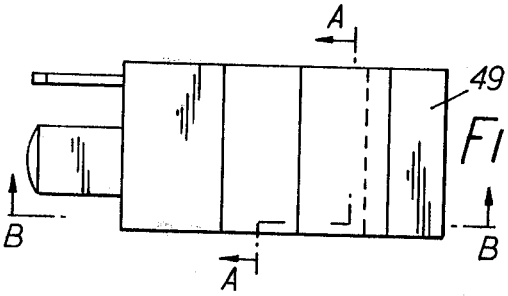
Figure 5:
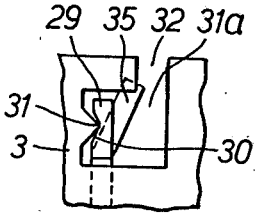
FIG. 5 shows a detail of a bearing for the bell crank.
Figure 2:
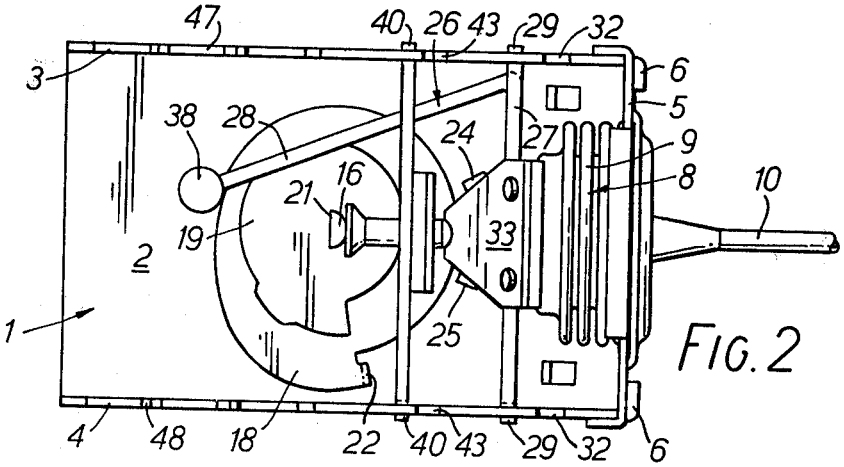
FIG. 2 is a plan view of the assembled switching device without the insulating housing.
Figure 3:
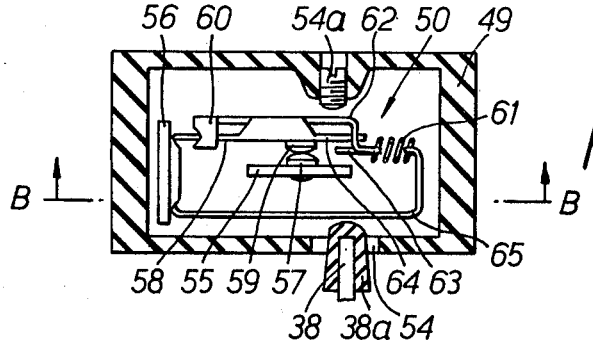
FIG. 3 is a section through the insulating housing on the line A—A in FIG. 1*a;*
Figure 4:
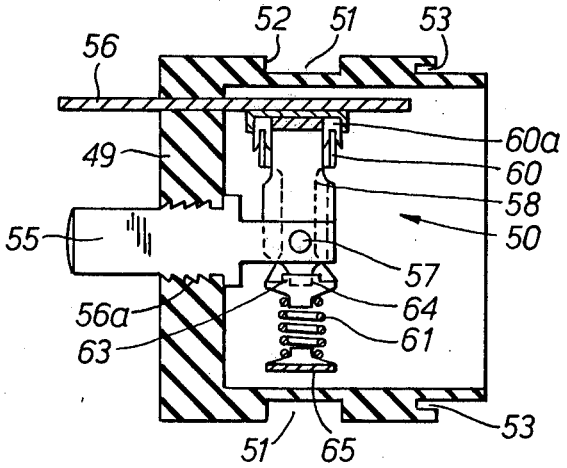
FIG. 4 is a section on the line B—B in FIGS. 1*a* and 3.

A punched-out and bent sheet metal part forms a carrier 1. This comprises a base wall 2 and two side walls 3 and 4. An end wall 5 is connected to the base wall 2 and side walls 3 and 4 by means of bent-over lugs 6; it carries an operating element 8 which is enclosed by corrugated tube bellows 9 and has a pressure chamber 11 which is accessible by way of a capillary tube 10.

The base wall 2 is provided with a sleeve 12 through which there passes a servo-element 15 having a shank 14 provided with a collar 13. The shank carries a pin 16 which is mounted eccentrically or has a non-circular cross-section and it is provided with barbed ribs 17. The component 13–17 is of steel. A cam disc 18 likewise of steel is connected to a plastics cam plate 19. By means of a bearing extension 20, the latter is likewise mounted in the sleeve 12 and pressed on the pin 16 by means of an aperture 21. The cam disc 18 has a downwardly bent lug 22. The part 23 of the base wall surrounding the shank is pressed inwardly so that the lug 22 can be moved freely. Two abutments 24 and 25 are bent upwardly out of the base wall. By co-operation with the lug 22, the rotary angle of the servo-element 15 is limited.

A bell crank 26 comprises two sections 27 and 28. At the upper end of the section 27 there are two outwardly projecting bearing lugs 29 provided with a notch 30. The notch rests on knife edge bearings 31 provided in a bearing punch-out 31*a* and connected to the upper edge of the side wall by way of a slot 32. In this way one obtains a bearing. The section 27 is loaded by the operating element 8 and its bearing lugs 29 are therefore pressed against the knife edge bearings 31. A leaf spring 33 composed of two springs is mounted by one end 34 on a part 35 of the section 27 disposed on the side of the bearing axis opposite to the line of attack of the operating element 8. The other end 36 of the leaf spring lies against a set screw 37. Consequently the bell crank assumes a position which depends on the pressure in the operating element 8 and the position of the set screw 37. An actuating extension 38 provided with an insulating cap 38*a* is provided at the end of the other section 28 of the bell crank 26.

The set screw 37 is held in a pivot plate 39 which has two bearing lugs 40 held against knife edge bearings 41. The latter are formed in a bearing cut-out 42 which is connected to the upper edge of the side walls by way of a slot 43. A plastics clamping element 44 has a hole which is clampingly seated on the screwthread of the set screw 37. This clamping element is secured against rotation because it lies against the bent-out projection 45 of the pivot plate 39. This projection co-operates with the peripheral face of the cam plate 19. The section 27 of the bell crank 26 likewise has an extension 46 against which the cam of the cam disc 18 comes to lie in the terminal position of the servo-element 15.

By means of cut-outs, parallel lugs 47 provided with barbed teeth 48 are formed at the side walls 3 and 4. They serve to secure the insulating housing 49 of a switching system 50. The insulating housing has grooves 51 with the side walls 52 of which the barbed teeth 48 come into engagement. Additional guiding on other parts of the side walls can be brought about with the aid of grooves 53. The insulating housing 49 also has an actuating aperture 54 through which the actuating extension 38, 39 can project into the interior of the housing. On the opposite side of the housing there is a set screw 54*a* with the aid of which the difference of the switching system can be set.

Two contact connectors 55 and 56 engaging through the housing are likewise reliably secured by means of barbed teeth 56*a*. The contact connector 55 carries a fixed contact 57 co-operating with a contact 59 which is held by a spring arm 58 and connected to the contact connector 56. The latter also carries a bearing 60*a* for a switch arm 60 of which the free end is loaded by a compression spring 61 and has two entrainments 62 and 63 for an extension 64 of the spring arm 58. The other end of the spring is mounted on a yoke 65 which is likewise secured to the contact connector 56 and on which the actuating extension 38 can act. The switching system 50 assumes the one or other switching position depending on the position of this actuating extension 38.

The assembly of this switching device is very simple. First of all the end plate 5 is connected to the carrier 2 by turning the lugs 6 over. The servo-element is then mounted simply by pressing the cam plate 19 on the pin 16 of the shank 14. Thereafter the bell crank is inserted by simply passing the bearing lugs 29 through the slot 32 into the bearing punch-out 31. Similarly, the pivot plate 39 is assembled by passing its bearing lugs 40 through the slot 43 into the bearing punch-out 42. Finally, the insulating housing 48 is pressed on the lugs 47. It is now only necessary to adjust the setting of the range by actuating the set screw 37. If necesssary, the difference can be set with the aid of the set screw 54*a*.

Figure 6:
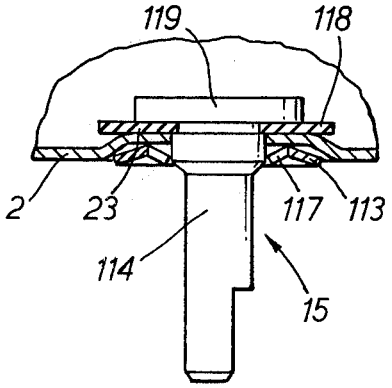
FIG. 6 shows an alternative form of securing the servo-element.

In a modification shown in FIG. 6, the shank 114 is of plastics material and made in one piece with the cam plate 119. Here, too, the cam disc 118 is injected. The shank is held by a steel collar 113 having inwardly directed barbed teeth 117 with which it becomes anchored in the softer material of the shank 114.

What is claimed is:

1. A pressure responsive electric switching assembly, comprising, a one piece sheet metal carrier having a base wall and two parallel sidewalls extending therefrom, an insulated housing containing an enclosed switching system and having an aperture through which said switching system can be actuated, said housing being connected to said carrier, a bell crank plate pivoted to said carrier and having an actuating element extending through said housing aperture for actuating said switching system, a pressure influenced operating element biasing said actuating element in one direction, spring means biasing said actuating element in the other direction, a rotary servo-element mounted on said carrier and having means for adjusting the spring tension of said spring means, a pair of vertically extending lug elements formed by said sidewalls, said insulated housing having wall means with grooves which receive said lug elements in press fitting relation for connecting said housing to said carrier.

2. A switching assembly according to claim 1 wherein said lug elements have barbs in the form of small stamped teeth.

3. A switching assembly according to claim 1 wherein said insulated housing has a floor portion with an aperture in alignment with said actuating element, said lug elements being perpendicular to said base wall, said grooves in said insulating housing extending parallel to said housing aperture, said actuating element having the form of a swing arm mounted between said insulating housing and said base wall.

4. A switching element according to claim 1 wherein said operating element is disposed at one end of said carrier between said side walls, said actuating element having the form of a bell crank which is pivoted in said side walls by its end thereof remote from its actuating end.

5. A switching assembly according to claim 4 wherein said bell crank has two lateral bearing lugs at its end opposite its actuating end, said side walls each have a first bearing punch-out forming a first cut-out with a knife edge, each said cut-out forming slot means offset from each said knife edge for introducing said bearing lugs to the free edge of said side wall opposite said base wall.

6. A switching assembly according to claim 5 wherein said bearing lugs are each provided with a notch which receive each said knife edge.

7. A switching assembly according to claim 4 wherein said spring means is formed by a leaf spring having one end thereof secured to said bell crank adjacent the pivotal axis thereof and on the side thereof opposite to where said operating element engages said bell crank, and the other end of said leaf spring being fixed near said base wall by means of said servo-element.

8. A switching assembly according to claim 7 wherein said spring means includes at least two superposed leaf springs.

9. A switching device according to claim 7 including a pivot plate carrying a set screw at the lower end thereof acting on said leaf spring and having bearing lugs at the upper end thereof, said side walls each having a second bearing punch-out forming a second cut-out with knife edge, each said second cut-out forming slot means offset from said second cut-out knife edge for introducing said pivot plate bearing lugs to the free edge of said side wall opposite said base wall.

10. A switching assembly according to claim 9 wherein said pivot plate has a bent-out projection in engagement with said servo-element and a clamping element penetrated by said set screw engaging said projection.

11. A switching assembly according to claim 1 wherein said servo-element has a shank which passes through said base wall, said servo-element having a cam plate on the inside of said base wall and a collar on the outside of said base wall, said collar being secured to said shank by being subsequently pressed on.

12. A switching assembly according to claim 11 wherein said shank is of a material softer than metal and said collar is of steel, said collar having inwardly directed barbed teeth.

13. A switching assembly according to claim 12, wherein said cam plate is integral with said shank.

14. A switching assembly according to claim 11 wherein said shank has an eccentrically disposed pin at its inner end, said cam plate being of a material softer than steel and having an aperture into which said pin is pressed.

15. A switching assembly according to claim 14 wherein said pin has barbed teeth.

16. A switching assembly according to claim 11 wherein said servo-element includes a cam disc which is disposed between said cam plate and said base wall, said cam disc making direct engagement with an extension on said bell crank in the end position of the servo-element.

17. A switching device according to claim 16 wherein said cam disc is of steel.

* * * * *